US010619862B2

(12) United States Patent
Bruin-Slot et al.

(10) Patent No.: US 10,619,862 B2
(45) Date of Patent: Apr. 14, 2020

(54) FRONTAL COOLING TOWERS FOR A VENTILATION SYSTEM OF A COOKING APPLIANCE

(71) Applicant: WHIRLPOOL CORPORATION, Benton Harbor, MI (US)

(72) Inventors: Zachary J. Bruin-Slot, Baroda, MI (US); Massimiliano Daniele, Cassinetta (IT); Robert Scott Donarski, St. Joseph, MI (US); Emilio Fagundes, Saint Joseph, MI (US); Gregory Tadeu Gargioni, Saint Joseph, MI (US); Vando Sestrem, Joinville (BR); Yasmim Silvano, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 67 days.

(21) Appl. No.: 16/021,730

(22) Filed: Jun. 28, 2018

(65) Prior Publication Data

US 2020/0003427 A1 Jan. 2, 2020

(51) Int. Cl.
*F24C 15/00* (2006.01)
*F24C 15/02* (2006.01)
(Continued)

(52) U.S. Cl.
CPC ..... *F24C 15/006* (2013.01); *F24C 15/028* (2013.01); *F24C 15/12* (2013.01); *F24C 15/16* (2013.01)

(58) Field of Classification Search
CPC ..... F24C 15/16; F24C 15/12; F24C 15/20
(Continued)

(56) References Cited

U.S. PATENT DOCUMENTS 1,141,176 A 6/1915 Copeman
1,380,656 A 6/1921 Lauth
(Continued)

FOREIGN PATENT DOCUMENTS

CA 2365023 A1 7/2002
CA 2734926 A1 10/2011
(Continued)

OTHER PUBLICATIONS

Built-In Gas Cooktop, image post date Feb. 18, 2015, originally cited by Examiner in U.S. Appl. No. 29/539,768 in Restriction Requirement dated Oct. 27, 2016, 10 pages, <http://www.bestbuy.com/site/kitchenaid-36-built-in-gas-cooktop-stainless-steel/8636634.p?skuId=8636634>.
(Continued)

*Primary Examiner* — Gregory L Huson
*Assistant Examiner* — Nikhil P Mashruwala
(74) *Attorney, Agent, or Firm* — Price Heneveld LLP

(57) ABSTRACT

A cooking appliance includes a housing having a sidewall and a front panel, wherein a heating cavity is defined within the housing. An operable door panel is rotationally coupled proximate the front panel and operable to provide selective access to the heating cavity via an aperture defined within the front panel. A heat source is in thermal communication with the heating cavity and the front panel. A blower is disposed within an interstitial space at least partially defined by an outer surface of the housing. A ventilation tower is attached to the sidewall and positioned proximate the front panel. Selective operation of the blower draws ventilation air from an external region proximate the front panel and into the interstitial space via the ventilation tower.

17 Claims, 10 Drawing Sheets

(51) Int. Cl.
*F24C 15/12* (2006.01)
*F24C 15/16* (2006.01)

(58) Field of Classification Search
USPC ..... 126/21 A
See application file for complete search history.

(56) References Cited

U.S. PATENT DOCUMENTS 1,405,624 A 2/1922 Patterson
1,598,996 A 9/1926 Wheelock
1,808,550 A 6/1931 Harpman
2,024,510 A 12/1935 Crisenberry
2,530,991 A 11/1950 Reeves
2,536,613 A 1/1951 Schulze et al.
2,699,912 A 1/1955 Cushman
2,739,584 A * 3/1956 Hupp ..... F24C 3/027 126/21 R
2,777,407 A 1/1957 Schindler
2,781,038 A 2/1957 Sherman
2,791,366 A 5/1957 Geisler
2,815,018 A 12/1957 Collins
2,828,608 A 4/1958 Cowlin et al.
2,847,932 A 8/1958 More
2,930,194 A 5/1960 Perkins
2,934,957 A 5/1960 Reinhart et al.
D191,085 S 8/1961 Kind et al.
3,017,924 A 1/1962 Jenson
3,051,813 A 8/1962 Busch et al.
3,065,342 A 11/1962 Worden
3,089,407 A 5/1963 Kinkle
3,259,120 A 7/1966 Keating
3,386,431 A 6/1968 Branson
3,463,138 A 8/1969 Lotter et al.
3,489,135 A 1/1970 Astrella
3,548,154 A 12/1970 Christiansson
3,602,131 A 8/1971 Dadson
3,645,249 A 2/1972 Henderson et al.
3,691,937 A 9/1972 Meek et al.
3,731,035 A 5/1973 Jarvis et al.
3,777,985 A 12/1973 Hughes et al.
3,780,954 A 12/1973 Genbauffs
3,857,254 A 12/1974 Lobel
3,877,865 A 4/1975 Duperow
3,899,655 A 8/1975 Skinner
D245,663 S 9/1977 Gordon
4,104,952 A 8/1978 Brass
4,149,518 A 4/1979 Schmidt et al.
4,363,956 A 12/1982 Scheidler et al.
4,413,610 A 11/1983 Berlik
4,418,456 A 12/1983 Riehl
4,447,711 A 5/1984 Fischer
4,466,789 A 8/1984 Riehl
4,518,346 A 5/1985 Pistien
4,587,946 A 5/1986 Doyon et al.
4,646,963 A 3/1987 Delotto et al.
4,654,508 A 3/1987 Logel et al.
4,689,961 A 9/1987 Stratton
4,796,600 A * 1/1989 Hurley ..... F24C 14/025 126/21 R
4,812,624 A 3/1989 Kern
4,818,824 A 4/1989 Dixit et al.
4,846,671 A 7/1989 Kwiatek
4,886,043 A 12/1989 Homer
4,891,936 A 1/1990 Shekleton et al.
D309,398 S 7/1990 Lund
4,981,416 A 1/1991 Nevin et al.
4,989,404 A 2/1991 Shekleton
5,021,762 A 6/1991 Hetrick
5,107,821 A * 4/1992 von Blanquet ..... F24C 15/04 126/19 R
5,136,277 A 8/1992 Civanelli et al.
5,171,951 A 12/1992 Chartrain et al.
D332,385 S 1/1993 Adams
5,190,026 A 3/1993 Doty
5,215,074 A 6/1993 Wilson et al.
5,243,172 A 9/1993 Hazan et al.
D340,383 S 10/1993 Addison et al.
5,272,317 A 12/1993 Ryu
D342,865 S 1/1994 Addison et al.
5,316,423 A 5/1994 Kin
5,397,234 A 3/1995 Kwiatek
5,448,036 A 9/1995 Husslein et al.
D364,993 S 12/1995 Andrea
5,491,423 A 2/1996 Turetta
D369,517 S 5/1996 Ferlin
5,546,927 A 8/1996 Lancelot
5,571,434 A 11/1996 Cavener et al.
D378,578 S 3/1997 Eberhardt
5,618,458 A 4/1997 Thomas
5,640,497 A 6/1997 Shute
5,649,822 A 7/1997 Gertler et al.
5,735,261 A 4/1998 Kieslinger
5,785,047 A 7/1998 Bird et al.
5,842,849 A 12/1998 Huang
5,913,675 A 6/1999 Vago et al.
5,918,589 A * 7/1999 Valle ..... F24C 15/2007 126/193
5,928,540 A 7/1999 Antoine et al.
D414,377 S 9/1999 Huang
5,967,021 A 10/1999 Yung
6,016,096 A 1/2000 Barnes et al.
6,030,207 A 2/2000 Saleri
6,049,267 A 4/2000 Barnes et al.
6,050,176 A 4/2000 Schultheis et al.
6,078,243 A 6/2000 Barnes et al.
6,089,219 A 7/2000 Kodera et al.
6,092,518 A 7/2000 Dane
6,111,229 A 8/2000 Schultheis
6,114,665 A 9/2000 Garcia et al.
6,133,816 A 10/2000 Barnes et al.
6,155,820 A 12/2000 Döbbeling
6,188,045 B1 2/2001 Hansen et al.
6,192,669 B1 2/2001 Keller et al.
6,196,113 B1 3/2001 Yung
6,253,759 B1 7/2001 Giebel et al.
6,253,761 B1 7/2001 Shuler et al.
6,320,169 B1 11/2001 Clothier
6,322,354 B1 11/2001 Carbone et al.
6,362,458 B1 3/2002 Sargunam et al.
6,452,136 B1 9/2002 Berkcan et al.
6,452,141 B1 9/2002 Shon
6,589,046 B2 7/2003 Harneit
6,614,006 B2 9/2003 Pastore et al.
6,619,280 B1 9/2003 Zhou et al.
6,655,954 B2 12/2003 Dane
6,663,009 B1 12/2003 Bedetti et al.
6,718,965 B2 4/2004 Rummel et al.
6,733,146 B1 5/2004 Vastano
6,806,444 B2 10/2004 Lerner
6,837,151 B2 1/2005 Chen
6,891,133 B2 5/2005 Shozo et al.
6,910,342 B2 6/2005 Berns et al.
6,930,287 B2 8/2005 Gerola et al.
6,953,915 B2 10/2005 Garris, III
7,005,614 B2 2/2006 Lee
7,017,572 B2 3/2006 Cadima
D524,105 S 7/2006 Poltronieri
7,083,123 B2 8/2006 Molla
7,220,945 B1 5/2007 Wang
D544,753 S 6/2007 Tseng
7,274,008 B2 9/2007 Arnal Valero et al.
7,281,715 B2 10/2007 Boswell
7,291,009 B2 11/2007 Kamal et al.
7,315,247 B2 1/2008 Jung et al.
7,325,480 B2 2/2008 Grühbaum et al.
D564,296 S 3/2008 Koch et al.
7,348,520 B2 3/2008 Wang
7,368,685 B2 5/2008 Nam et al.
7,411,160 B2 8/2008 Duncan et al.
7,414,203 B2 8/2008 Winkler
7,417,204 B2 8/2008 Nam et al.
7,429,021 B2 9/2008 Sather et al.
D581,736 S 12/2008 Besseas

(56) References Cited

U.S. PATENT DOCUMENTS 7,468,496 B2 * 12/2008 Marchand ..... F24C 15/2007 126/21 A
D592,445 S 5/2009 Sorenson et al.
7,527,495 B2 5/2009 Yam et al.
D598,959 S 8/2009 Kiddoo
7,589,299 B2 9/2009 Fisher et al.
D604,098 S 11/2009 Hamlin
7,614,877 B2 11/2009 McCrorey et al.
7,628,609 B2 12/2009 Pryor et al.
7,640,930 B2 1/2010 Little et al.
7,696,454 B2 4/2010 Nam et al.
7,708,008 B2 5/2010 Elkasevic et al.
7,721,727 B2 5/2010 Kobayashi
7,731,493 B2 6/2010 Starnini et al.
7,762,250 B2 * 7/2010 Elkasevic ..... F24C 15/006 126/190
7,770,985 B2 8/2010 Davis et al.
7,781,702 B2 8/2010 Nam et al.
7,823,502 B2 11/2010 Hecker et al.
7,829,825 B2 11/2010 Kühne
7,840,740 B2 11/2010 Minoo
7,841,333 B2 11/2010 Kobayashi
7,964,823 B2 6/2011 Armstrong et al.
D642,675 S 8/2011 Scribano et al.
8,006,687 B2 8/2011 Watkins et al.
8,015,821 B2 9/2011 Spytek
8,037,689 B2 10/2011 Oskin et al.
8,057,223 B2 11/2011 Pryor et al.
8,141,549 B2 3/2012 Armstrong et al.
8,217,314 B2 7/2012 Kim et al.
8,220,450 B2 7/2012 Luo et al.
8,222,578 B2 7/2012 Beier
D665,491 S 8/2012 Goel et al.
8,272,321 B1 9/2012 Kalsi et al.
8,288,690 B2 10/2012 Boubeddi et al.
8,302,593 B2 11/2012 Cadima
8,304,695 B2 11/2012 Bonuso et al.
8,342,165 B2 1/2013 Watkins
8,344,292 B2 1/2013 Franca et al.
8,356,367 B2 1/2013 Flynn
8,393,317 B2 3/2013 Sorenson et al.
8,398,303 B2 3/2013 Kuhn
8,430,310 B1 4/2013 Ho et al.
8,464,703 B2 6/2013 Ryu et al.
D685,225 S 7/2013 Santoyo et al.
D687,675 S 8/2013 Filho et al.
8,526,935 B2 9/2013 Besore et al.
8,528,537 B2 * 9/2013 Chilton ..... F24C 15/006 126/15 R
8,535,052 B2 9/2013 Cadima
D693,175 S 11/2013 Saubert
8,584,663 B2 11/2013 Kim et al.
8,596,259 B2 12/2013 Padgett et al.
8,616,193 B2 12/2013 Padgett
8,660,297 B2 2/2014 Yoon et al.
8,687,842 B2 4/2014 Yoon et al.
8,689,782 B2 4/2014 Padgett
8,707,945 B2 4/2014 Hasslberger et al.
8,747,108 B2 6/2014 Lona Santoyo et al.
8,800,543 B2 8/2014 Simms et al.
D718,061 S 11/2014 Wu
8,887,710 B2 11/2014 Rossi et al.
8,930,160 B2 1/2015 Wall et al.
8,932,049 B2 1/2015 Ryu et al.
8,950,389 B2 2/2015 Horstkoetter et al.
8,978,637 B2 3/2015 Ryu et al.
D727,489 S 4/2015 Rohskopf et al.
9,021,942 B2 5/2015 Lee et al.
9,074,765 B2 7/2015 Armanni
D735,525 S 8/2015 Nguyen
9,113,503 B2 8/2015 Arnal Valero et al.
9,132,302 B2 9/2015 Luongo et al.
D743,203 S 11/2015 Filho et al.
9,175,858 B2 11/2015 Tisselli et al.
D750,314 S 2/2016 Hobson et al.
9,307,888 B2 4/2016 Baldwin et al.
D758,107 S 6/2016 Hamilton
9,400,115 B2 7/2016 Kuwamura
D766,036 S 9/2016 Koch et al.
D766,696 S 9/2016 Kemker
9,513,015 B2 12/2016 Estrella et al.
9,521,708 B2 12/2016 Adelmann et al.
9,557,063 B2 1/2017 Cadima
9,572,475 B2 2/2017 Gephart et al.
9,644,847 B2 5/2017 Bhogal et al.
9,696,042 B2 * 7/2017 Hasslberger ..... F24C 15/006
9,879,864 B2 1/2018 Gutierrez et al.
9,927,129 B2 3/2018 Bhogal et al.
2002/0065039 A1 5/2002 Benezech et al.
2004/0007566 A1 1/2004 Staebler et al.
2004/0031782 A1 2/2004 Westfield
2004/0195399 A1 10/2004 Molla
2004/0224273 A1 11/2004 Inomata
2004/0224274 A1 11/2004 Tomiura
2005/0029245 A1 2/2005 Gerola et al.
2005/0112520 A1 5/2005 Todoli et al.
2005/0199232 A1 9/2005 Gama et al.
2005/0268000 A1 12/2005 Carlson
2005/0268794 A1 12/2005 Nesterov
2006/0237425 A1 * 10/2006 Kim ..... F24C 15/006 219/400
2007/0124972 A1 6/2007 Ratcliffe
2007/0181410 A1 8/2007 Baier
2007/0251936 A1 11/2007 Nam et al.
2007/0281267 A1 12/2007 Li
2008/0029081 A1 2/2008 Gagas
2008/0050687 A1 2/2008 Wu
2008/0173632 A1 7/2008 Jang et al.
2008/0210685 A1 9/2008 Beier
2009/0032010 A1 * 2/2009 Hoffmeier ..... F24C 15/006 126/198
2009/0173730 A1 7/2009 Baier et al.
2009/0320823 A1 12/2009 Padgett
2010/0035197 A1 2/2010 Cadima
2010/0114339 A1 5/2010 Kaiser et al.
2010/0126496 A1 5/2010 Luo et al.
2010/0154776 A1 6/2010 Czajka et al.
2010/0192939 A1 8/2010 Parks
2011/0027733 A1 2/2011 Yamamoto et al.
2011/0142998 A1 6/2011 Johncock et al.
2011/0163086 A1 7/2011 Aldana Arjol et al.
2011/0248021 A1 10/2011 Gutierrez et al.
2012/0017595 A1 1/2012 Liu
2012/0024835 A1 2/2012 Artal Lahoz et al.
2012/0036855 A1 2/2012 Hull
2012/0037142 A1 * 2/2012 Chilton ..... F24C 3/008 126/21 R
2012/0067334 A1 3/2012 Kim et al.
2012/0076351 A1 3/2012 Yoon et al.
2012/0099761 A1 4/2012 Yoon et al.
2012/0160228 A1 6/2012 Kim et al.
2012/0171343 A1 7/2012 Cadima et al.
2012/0261405 A1 10/2012 Kurose et al.
2013/0043239 A1 2/2013 Anton Falcon et al.
2013/0252188 A1 9/2013 Chen
2013/0255663 A1 10/2013 Cadima et al.
2013/0260618 A1 10/2013 Bally et al.
2013/0333684 A1 * 12/2013 Cescot ..... F24C 15/2007 126/21 A
2014/0048055 A1 2/2014 Ruther
2014/0071019 A1 3/2014 Lim
2014/0090636 A1 4/2014 Bettinzoli
2014/0097172 A1 4/2014 Kang et al.
2014/0116416 A1 5/2014 Saubert
2014/0137751 A1 5/2014 Bellm
2014/0139381 A1 5/2014 Sippel
2014/0318527 A1 10/2014 Silva et al.
2014/0352549 A1 12/2014 Upston et al.
2015/0096974 A1 4/2015 Freeman et al.
2015/0136760 A1 5/2015 Lima et al.
2015/0153041 A1 6/2015 Neumeier
2015/0241069 A1 8/2015 Brant et al.
2015/0330640 A1 11/2015 Stork genannt Wersborg
2015/0345800 A1 12/2015 Cabrera Botello

(56) References Cited

U.S. PATENT DOCUMENTS

| | | | |
|---|---|---|---|
| 2015/0359045 | A1 | 12/2015 | Neukamm et al. |
| 2016/0029439 | A1 | 1/2016 | Kurose et al. |
| 2016/0061490 | A1 | 3/2016 | Cho et al. |
| 2016/0091210 | A1 | 3/2016 | Ceccoli |
| 2016/0095469 | A1 | 4/2016 | Gregory et al. |
| 2016/0116160 | A1 | 4/2016 | Takeuchi |
| 2016/0153666 | A1 | 6/2016 | Tcaciuc |
| 2016/0174768 | A1 | 6/2016 | Deverse |
| 2016/0178209 | A1 | 6/2016 | Park et al. |
| 2016/0178212 | A1 | 6/2016 | Park et al. |
| 2016/0187002 | A1 | 6/2016 | Ryu et al. |
| 2016/0201902 | A1 | 7/2016 | Cadima |
| 2016/0209044 | A1 | 7/2016 | Cadima |
| 2016/0209045 | A1 | 7/2016 | Millius |
| 2016/0295644 | A1 | 10/2016 | Khokle et al. |
| 2016/0296067 | A1 | 10/2016 | Laws |
| 2017/0003033 | A1 | 1/2017 | Lona Santoyo et al. |
| 2017/0067651 | A1 | 3/2017 | Khokle et al. |
| 2017/0074522 | A1 | 3/2017 | Cheng |
| 2017/0082296 | A1 | 3/2017 | Jeong et al. |
| 2017/0082299 | A1 | 3/2017 | Rowley et al. |
| 2017/0108228 | A1 | 4/2017 | Park et al. |
| 2017/0115008 | A1 | 4/2017 | Erbe et al. |
| 2017/0261213 | A1 | 4/2017 | Park et al. |
| 2017/0223774 | A1 | 8/2017 | Cheng et al. |
| 2018/0058702 | A1 | 3/2018 | Jang et al. |
| 2019/0145627 | A1* | 5/2019 | Johnson ..... F24C 15/2007 126/21 R |

FOREIGN PATENT DOCUMENTS

| | | | |
|---|---|---|---|
| CN | 201680430 | U | 12/2010 |
| DE | 7242625 | | 3/1973 |
| DE | 2845869 | | 4/1980 |
| DE | 3014908 | | 10/1981 |
| DE | 3238441 | A1 | 4/1984 |
| DE | 3446621 | A1 | 6/1986 |
| DE | 3717728 | A1 | 12/1988 |
| DE | 3150450 | C2 | 8/1989 |
| DE | 3839657 | | 5/1990 |
| DE | 4103664 | C1 | 1/1992 |
| DE | 4228076 | | 5/1993 |
| DE | 4445594 | | 6/1996 |
| DE | 10218294 | A1 | 11/2003 |
| DE | 60004581 | T2 | 6/2004 |
| DE | 102004002466 | A1 | 8/2005 |
| DE | 1020040009606 | | 9/2005 |
| DE | 102005059505 | A1 | 6/2007 |
| DE | 19912452 | B4 | 10/2007 |
| DE | 102006034391 | A1 | 1/2008 |
| DE | 102007021297 | A1 | 11/2008 |
| DE | 102008027220 | A1 | 12/2009 |
| DE | 102008042467 | A1 | 4/2010 |
| DE | 102008051829 | A1 | 4/2010 |
| DE | 102009002276 | A1 | 10/2010 |
| DE | 102013218714 | A1 | 4/2014 |
| EP | 0000908 | A1 | 3/1979 |
| EP | 0122966 | | 10/1984 |
| EP | 0429120 | A2 | 5/1991 |
| EP | 0620698 | A1 | 10/1994 |
| EP | 0690659 | A2 | 1/1996 |
| EP | 1030114 | A1 | 8/2000 |
| EP | 1217306 | | 6/2002 |
| EP | 1344986 | A1 | 9/2003 |
| EP | 1586822 | A1 | 10/2005 |
| EP | 1617148 | A1 | 1/2006 |
| EP | 1099905 | B1 | 2/2006 |
| EP | 1201998 | B1 | 3/2006 |
| EP | 1460342 | B1 | 5/2006 |
| EP | 2063181 | A2 | 5/2009 |
| EP | 2063444 | A1 | 5/2009 |
| EP | 2070442 | | 6/2009 |
| EP | 2116775 | A1 | 11/2009 |
| EP | 2116829 | A1 | 11/2009 |
| EP | 2278227 | | 1/2011 |
| EP | 2299181 | A1 | 3/2011 |
| EP | 2375170 | A1 | 10/2011 |
| EP | 2144012 | B1 | 9/2012 |
| EP | 2657615 | | 10/2013 |
| EP | 2816291 | A1 | 12/2014 |
| EP | 2835580 | A2 | 2/2015 |
| EP | 3006832 | A1 | 4/2016 |
| EP | 2848867 | B1 | 9/2017 |
| FR | 2712071 | | 5/1995 |
| FR | 2787556 | A1 | 6/2000 |
| FR | 2789753 | A1 | 8/2000 |
| FR | 3003338 | A1 | 9/2014 |
| GB | 2158225 | A | 11/1985 |
| JP | 2001141244 | A | 5/2001 |
| JP | 2005009693 | A | 1/2005 |
| JP | 2007147131 | A | 6/2007 |
| JP | 2010038475 | A | 2/2010 |
| JP | 2011144982 | A | 7/2011 |
| JP | 2011257021 | A | 12/2011 |
| WO | 1991013526 | A1 | 9/1991 |
| WO | 9850736 | A1 | 11/1998 |
| WO | 2006072388 | A1 | 7/2006 |
| WO | 2006136363 | A1 | 12/2006 |
| WO | 2012077050 | A2 | 6/2012 |
| WO | 2013098330 | A2 | 7/2013 |
| WO | 2013104521 | A1 | 7/2013 |
| WO | 2013182410 | | 12/2013 |
| WO | 2014194176 | A1 | 12/2014 |
| WO | 2015086420 | A1 | 6/2015 |

OTHER PUBLICATIONS

True-Heat burner, image post date Jan. 30, 2015, originally cited by Examiner in U.S. Appl. No. 29/539,768 in Restriction Requirement dated Oct. 27, 2016, 2 pages, <http://ovens.reviewed.com/news/kitchenaid-has-a-new-flame>.

Metal Cover Gas Hob, image post date 2012, originally cited by Examiner in U.S. Appl. No. 29/539,768 in Restriction Requirement dated Oct. 27, 2016, 13 pages, <http://inse.gmc.globalmarket.com/products/details/metal-cover-gas-hob-8516959.html>.

Penny Stove, image post date 2004, originally cited by Examiner in U.S. Appl. No. 29/539,768 in Restriction Requirement dated Oct. 27, 2016, 30 pages, <http://www.jureystudio.com/pennystove/stoveinstruction.html>.

* cited by examiner

FRONTAL COOLING TOWERS FOR A VENTILATION SYSTEM OF A COOKING APPLIANCE

BACKGROUND

The device is in the field of cooking appliances, and more specifically, a ventilation system of a cooking appliance that incorporates one or more ventilation towers towards a front of the cooking appliance.

SUMMARY

In at least one aspect, a cooking appliance includes a housing having a sidewall and a front panel, wherein a heating cavity is defined within the housing. An operable door panel is rotationally coupled proximate the front panel and operable to provide selective access to the heating cavity via an aperture defined within the front panel. A heat source is in thermal communication with the heating cavity and the front panel. A blower is disposed within an interstitial space at least partially defined by an outer surface of the housing. A ventilation tower is attached to the sidewall and positioned proximate the front panel. Selective operation of the blower draws ventilation air from an external region proximate the front panel and into the interstitial space via the ventilation tower.

In at least another aspect, a heating and ventilation system for a cooking appliance includes a heat source that selectively delivers heat to a heating cavity defined within a housing. An outer ventilation path extends around at least a portion of an exterior of the housing. A ventilation tower is disposed proximate a sidewall of the housing and in communication with the outer ventilation path. A blower is disposed within the outer ventilation path and is selectively operable to move ventilation air from the ventilation tower and into the outer ventilation path. The ventilation tower includes a side vent that cooperates with the blower to direct cooling air from areas external to the outer ventilation path into the ventilation tower to at least partially define the ventilation air.

In at least another aspect, a heating appliance includes an upper housing including an upper heat source that delivers heat to an upper heating cavity defined within the upper housing. A lower housing includes a lower heat source that delivers heat to a lower heating cavity defined with in the lower housing. A heating and ventilation system includes an outer ventilation path extending around an outer surface of each of the upper and lower housings. Upper and lower ventilation towers are disposed at sidewalls of the upper and lower housings, respectively. Each of the upper and lower ventilation towers are in communication with the outer ventilation path. At least one blower is disposed within the outer ventilation path and is selectively operable to move ventilation air from at least one of the upper and lower ventilation towers and into the outer ventilation path. Each ventilation tower of the upper and lower ventilation towers includes a side vent that cooperates with the at least one blower to direct cooling air from areas external to the outer ventilation path and the upper and lower housings and into the outer ventilation path to partially define the ventilation air.

These and other features, advantages, and objects of the present device will be further understood and appreciated by those skilled in the art upon studying the following specification, claims, and appended drawings.

DETAILED DESCRIPTION OF EMBODIMENTS

Figure 1:
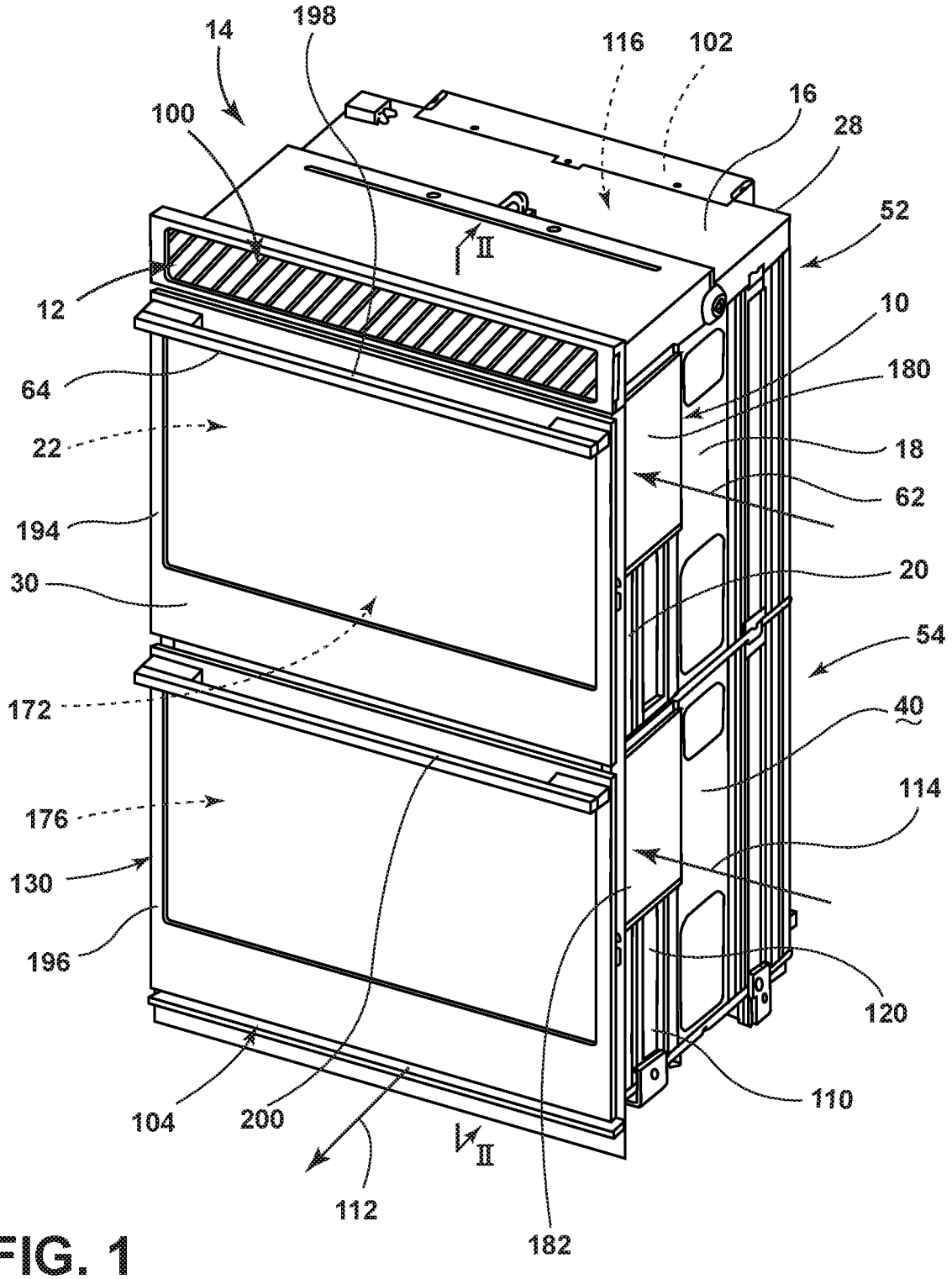
FIG. 1 is a front perspective view of a cooking appliance incorporating an aspect of the ventilation towers within the ventilation system of the cooking appliance.
Figure 2:
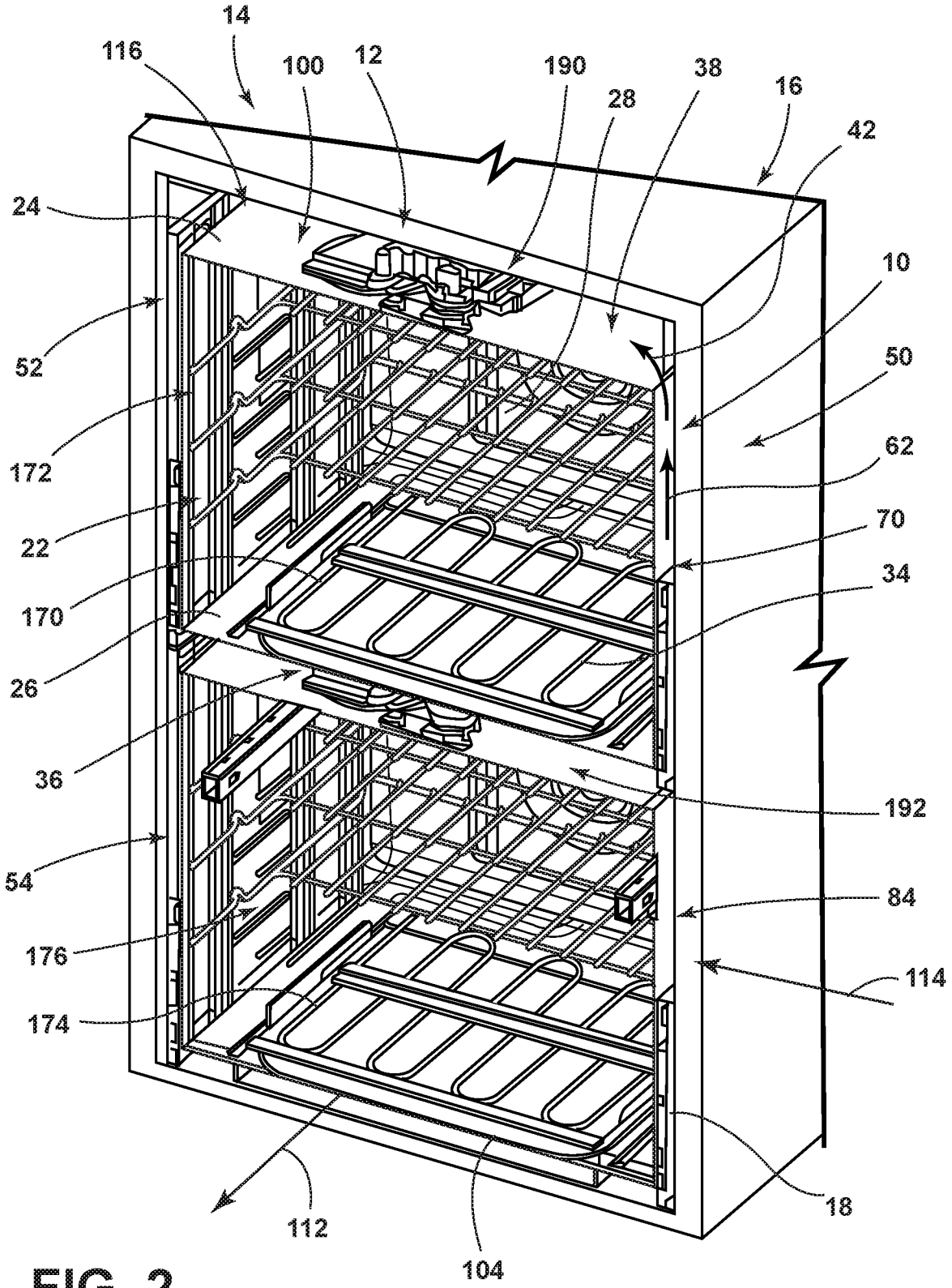
FIG. 2 is a cross-sectional view of the cooking appliance of FIG. 1 taken along line II-II and showing movement of ventilation air through the ventilation towers.
Figure 3:
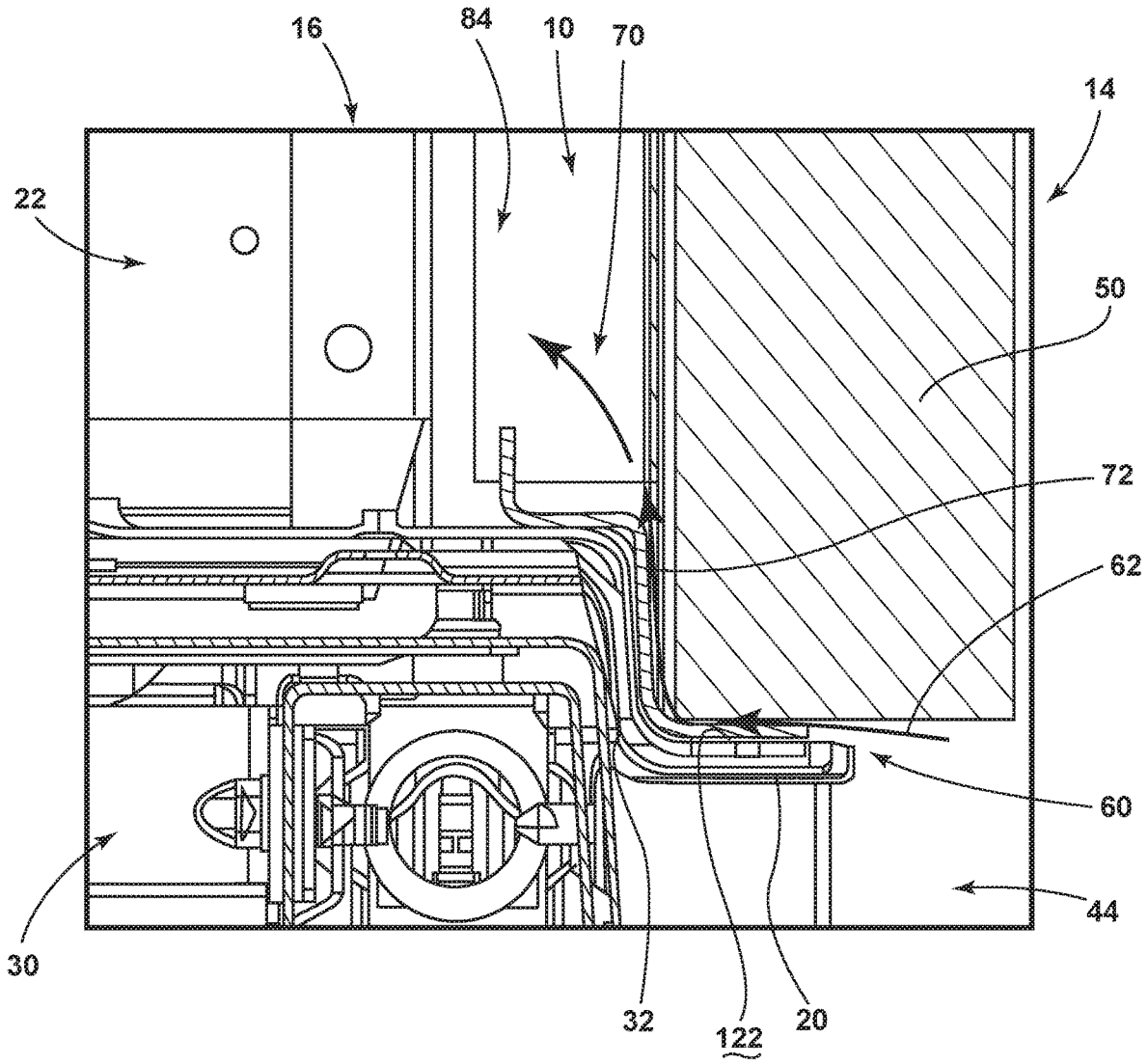
FIG. 3 is a partial cross-sectional view of the appliance of FIG. 1 illustrating movement of ventilation air through the ventilation tower.
Figure 4:
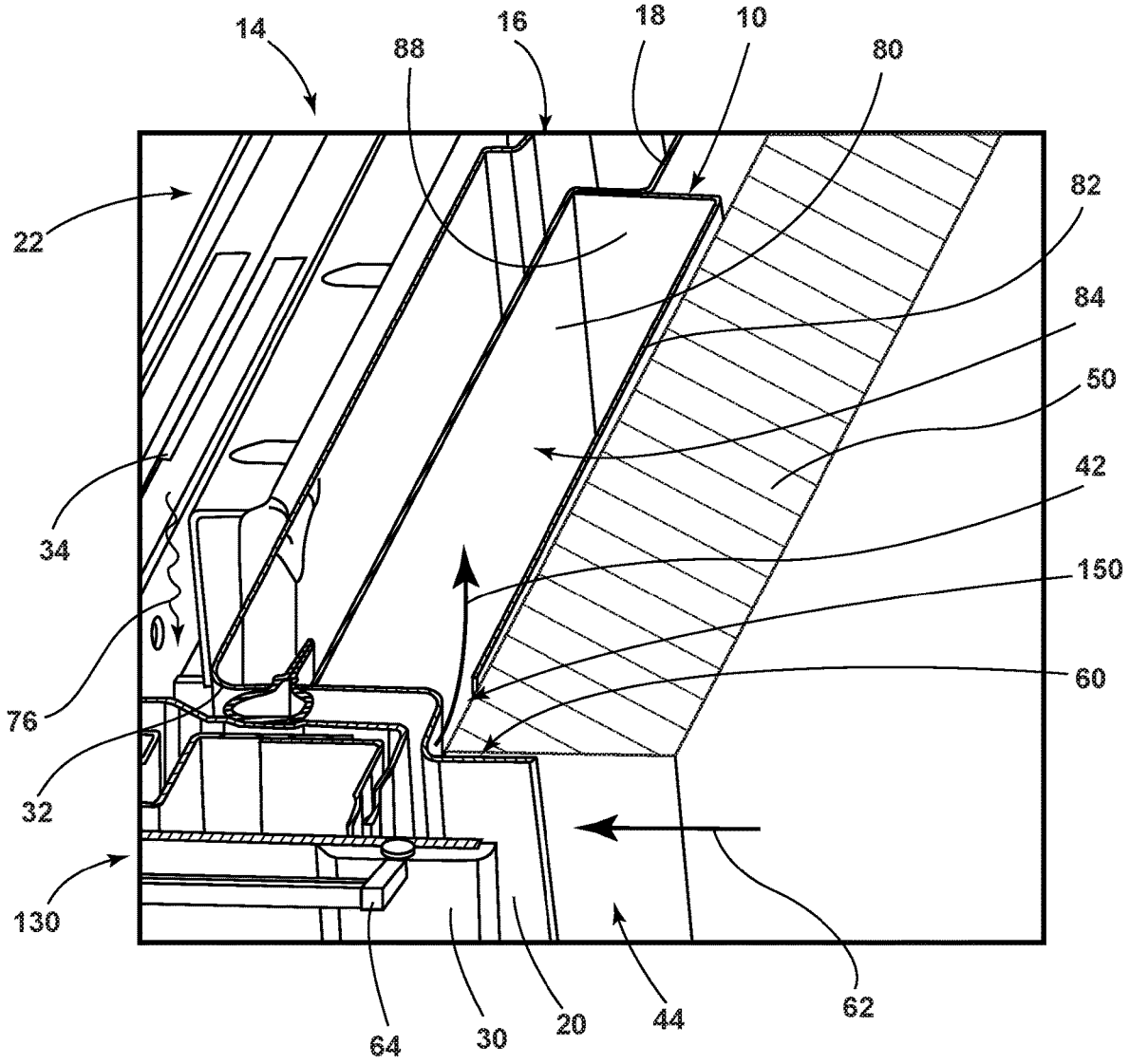
FIG. 4 is a cross-sectional perspective view of the appliance generally exemplified in FIG. 3.
Figure 5:
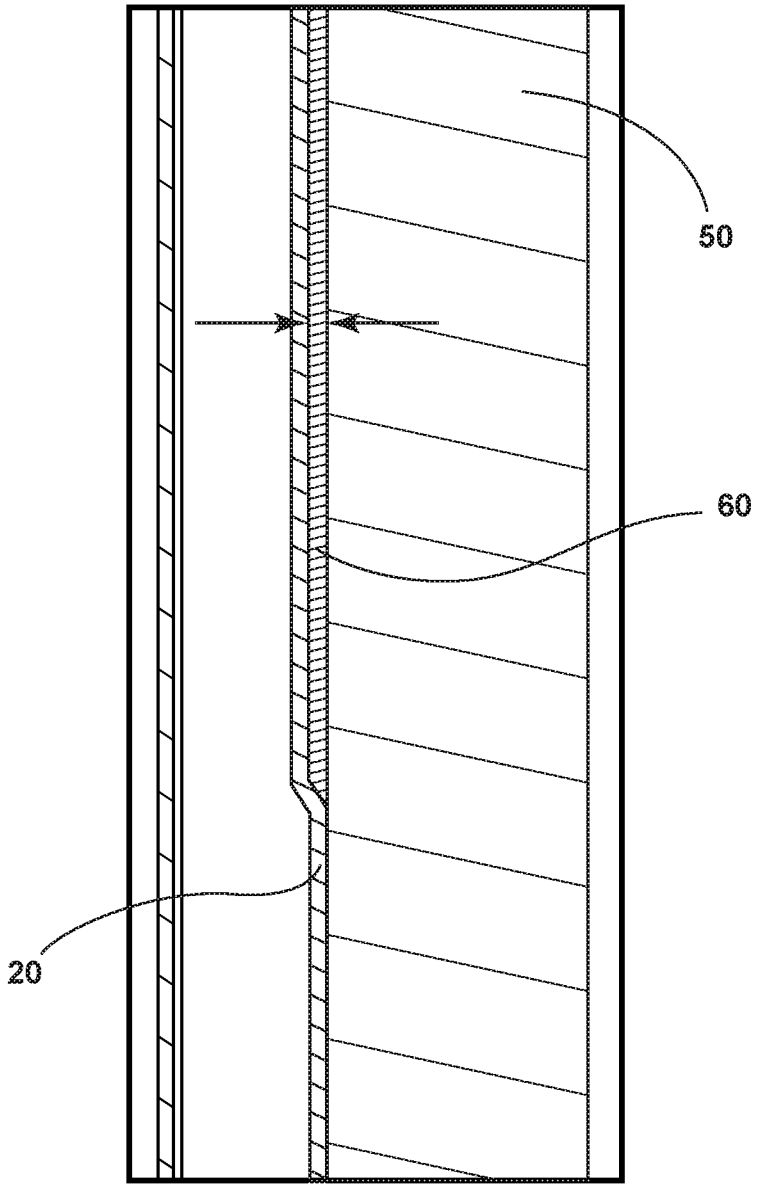
FIG. 5 is a partial side elevational view of the appliance of FIG. 1 and showing a gap providing for entry of ventilation air into the ventilation towers.
Figure 6:
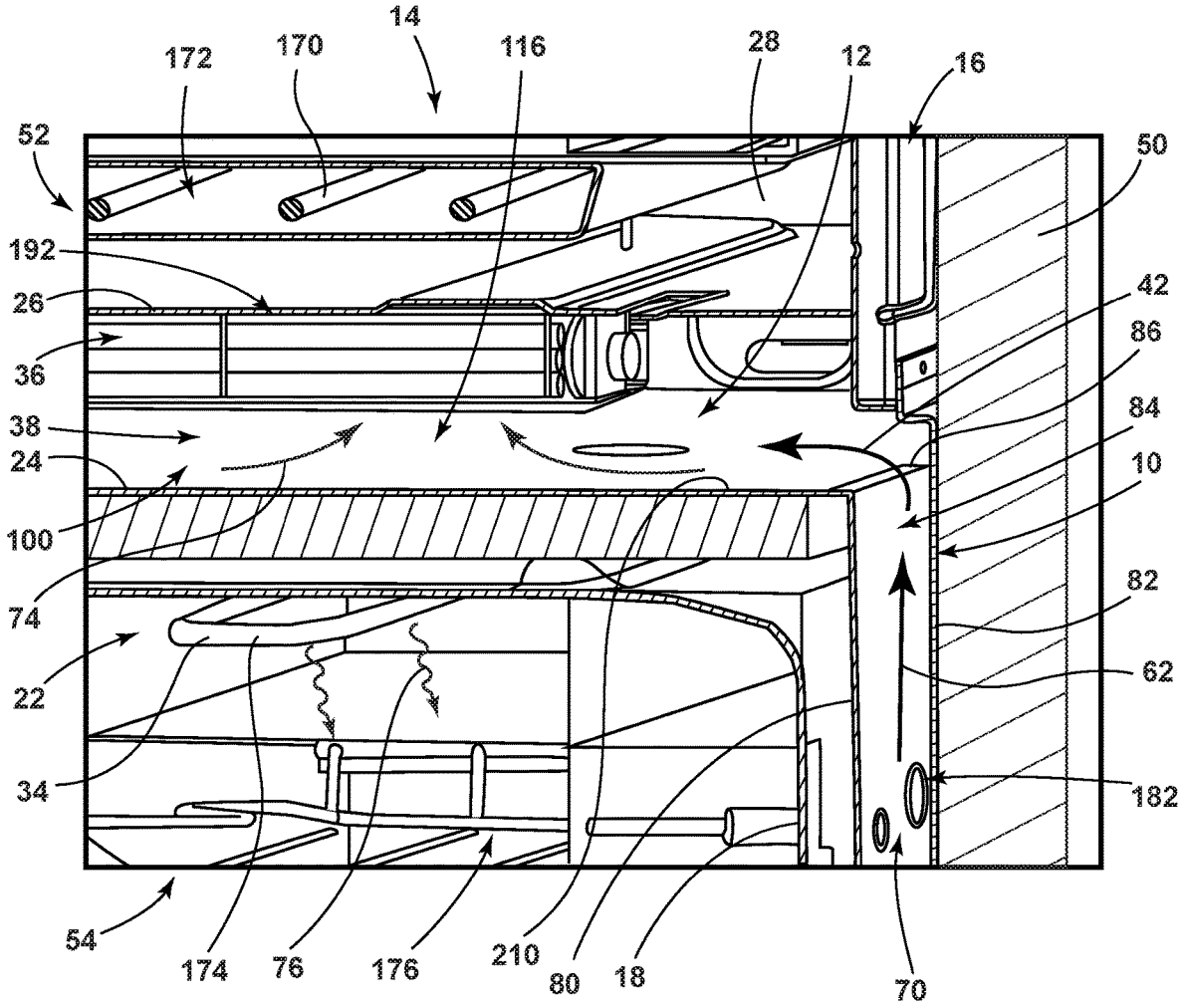
FIG. 6 is a cross-sectional view of an aspect of a cooking appliance, taken through a ventilation tower and showing movement of air into an interstitial space within the cooking appliance.
Figure 7:
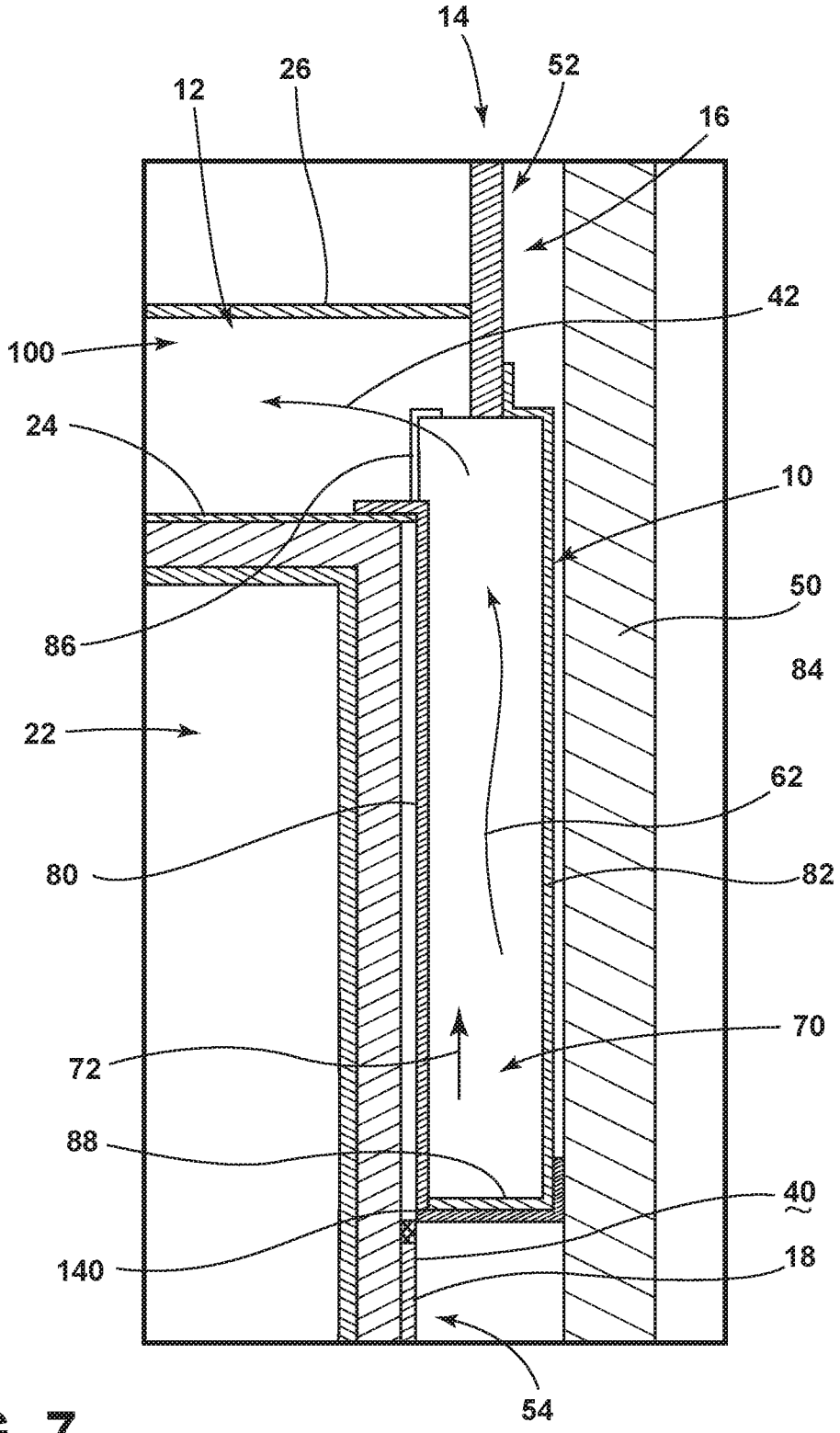
FIG. 7 is a cross-sectional view of an aspect of the ventilation tower engaged with the sidewall of the appliance.
Figure 8:
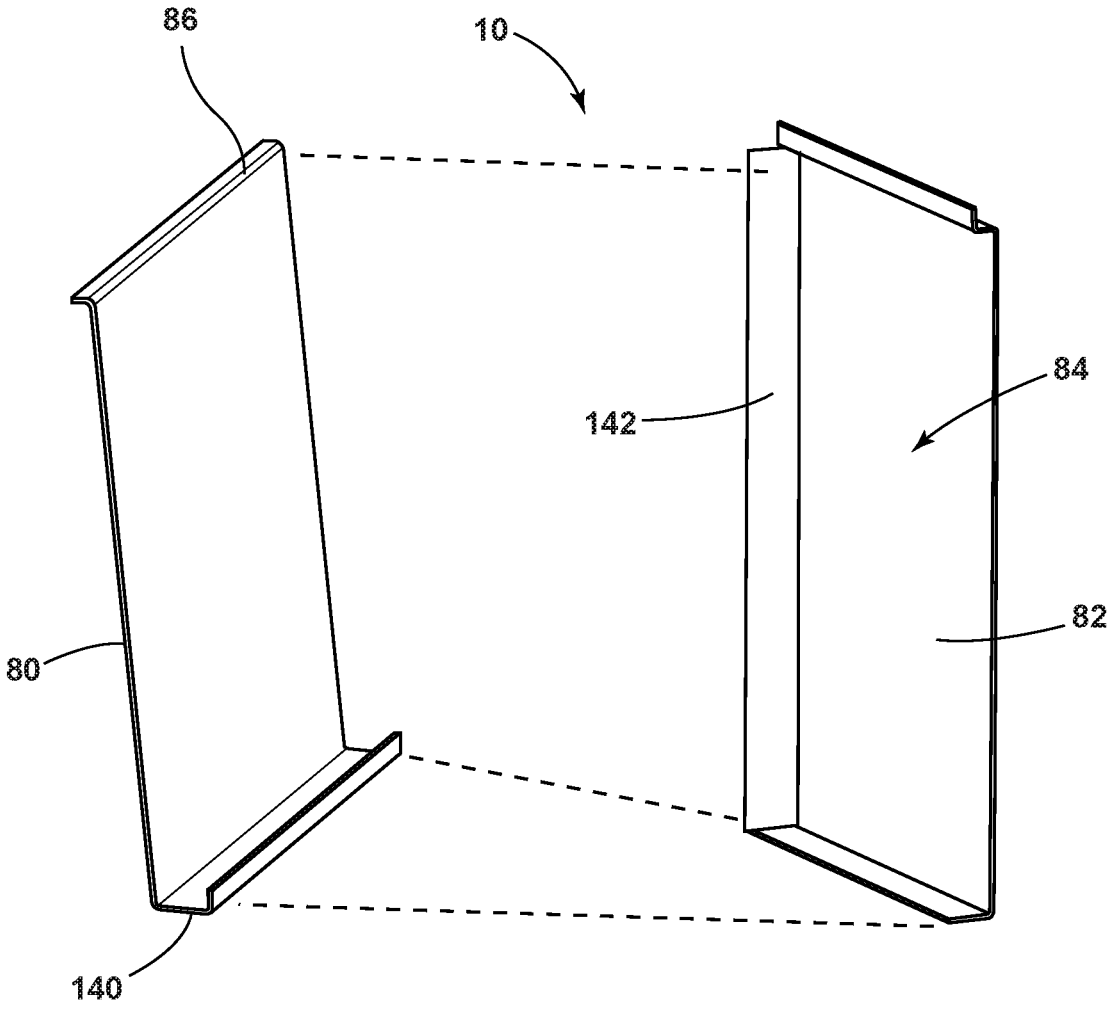
FIG. 8 is an exploded perspective view of the inner and outer panels of an aspect of the ventilation tower.
Figure 9:
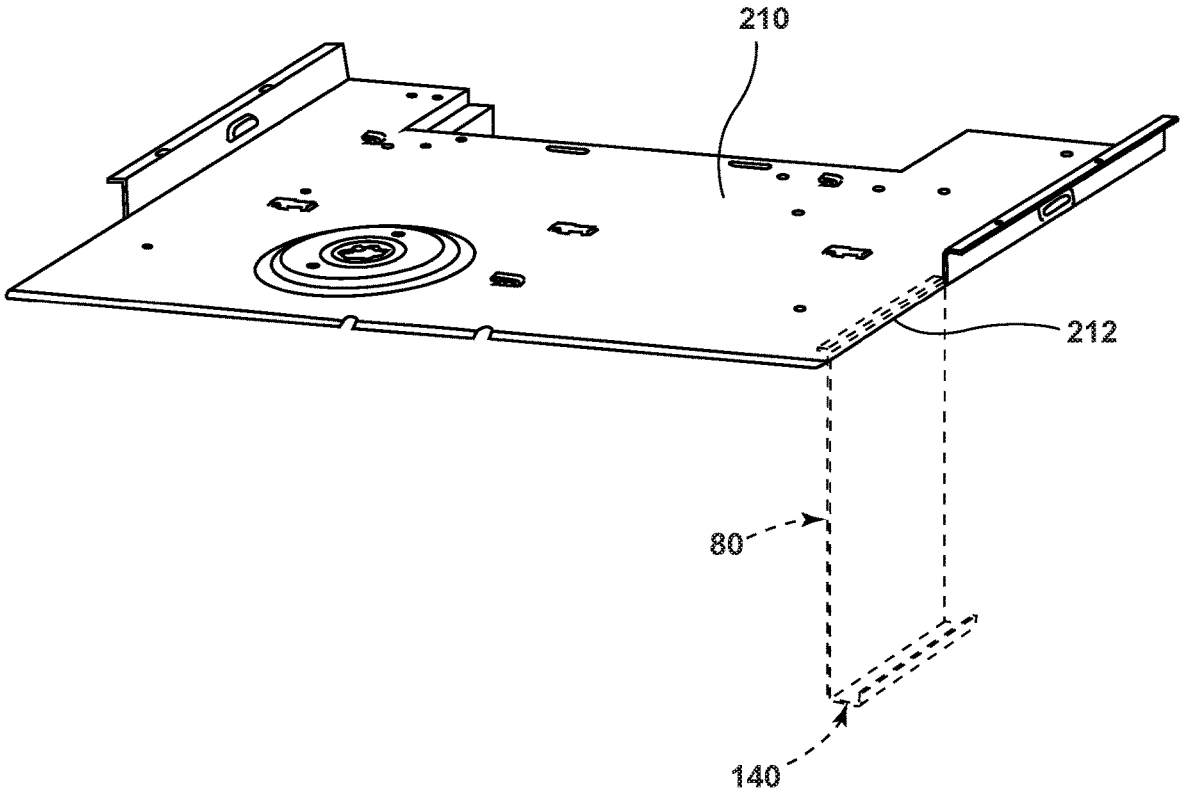
FIG. 9 is a perspective view of an aspect of a top panel for a housing of a cooking appliance.
Figure 10:
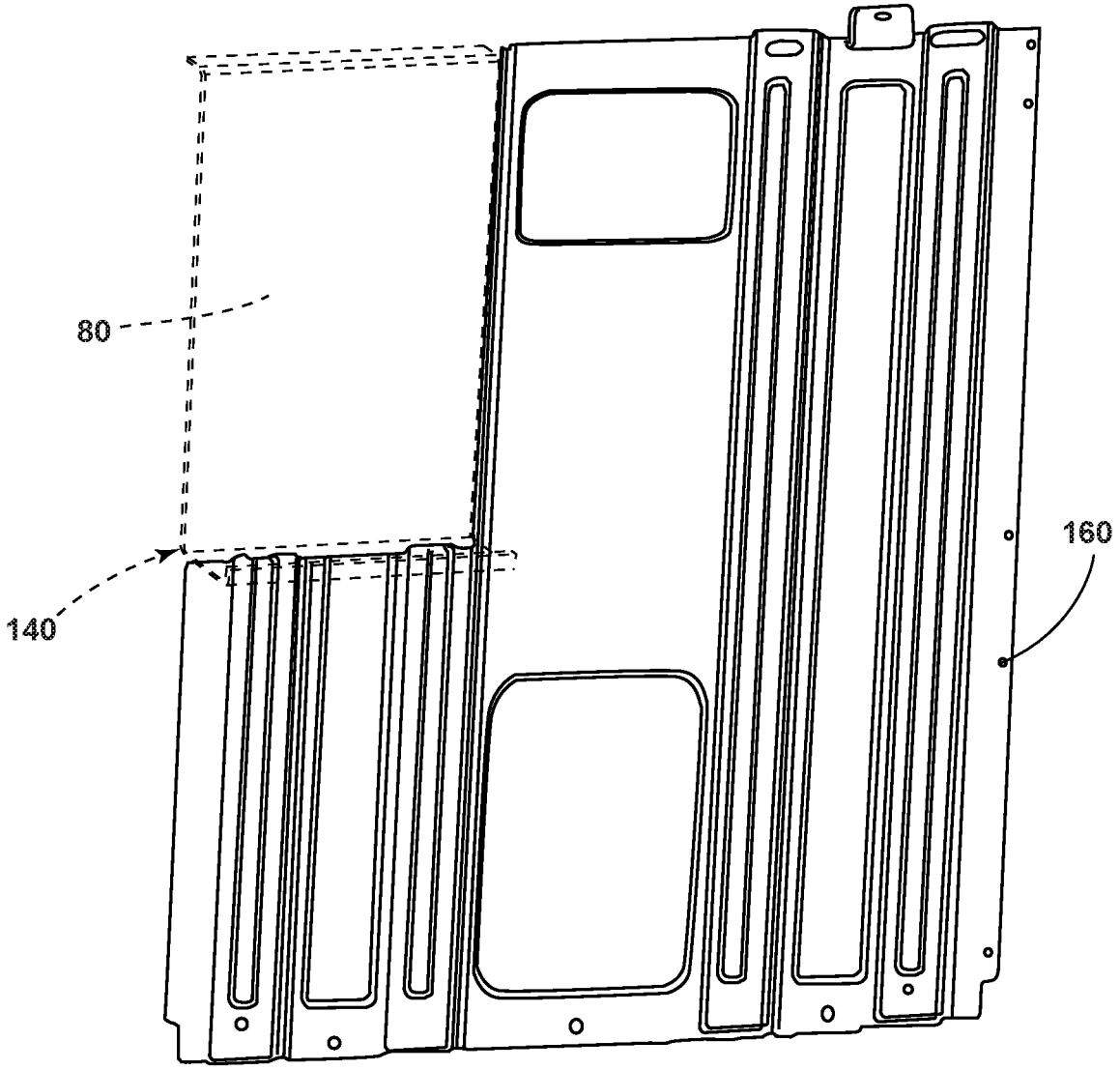
FIG. 10 is a perspective view of a side panel for a housing of a cooking appliance.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As exemplified in FIGS. 1-6, reference numeral 10 generally refers to a ventilation tower that is incorporated within an air handling system 12 for a cooking appliance 14. According to various aspects of the device, the cooking appliance 14 includes a housing 16 having a sidewall 18 and a front panel 20. A heating cavity 22 is defined within the housing 16, where the heating cavity 22 provides space within which cooking operations can be performed. The housing 16 can include multiple sidewalls 18. These sidewalls 18 can include a top wall 24, a bottom wall 26 and a back wall 28 that cooperate to define the heating cavity 22 of the housing 16. An operable door panel 30 is rotationally coupled proximate the front panel 20 of the housing 16 and is operable to provide selective access to the heating cavity 22 via an aperture 32 defined within the front panel 20 of the housing 16. A heat source 34 is disposed in thermal communication with the heating cavity 22 and the front panel 20. A blower 36 for the air handling system 12 is disposed within an interstitial space 38 at least partially defined by an outer surface 40 of the housing 16. The ventilation tower 10 of the air handling system 12 is attached to the sidewall 18 and is positioned proximate the front panel 20. Selective operation of the blower 36 serves to draw ventilation air 42 from an external region 44 proximate the front panel 20 and into the interstitial space 38 via the ventilation tower 10.

According to various aspects of the device, as exemplified in FIGS. 1-6, aspects of the ventilation tower 10 can be used in conjunction with a built-in cooking appliance 14 that is disposed within cabinetry or other fixtures within a commercial or residential kitchen setting. Typically, a cabinet structure 50 surrounds the housing 16 and the interstitial space 38 for the cooking appliance 14 can be defined at least partially between the housing 16 and the cabinet structure 50. Where the built-in cooking appliance 14 is a double-type oven, the interstitial space 38 can also be defined between an upper housing 52 and a lower housing 54 for the cooking appliance 14.

Referring again to FIGS. 3-6, a side vent 60 for the air handling system 12 is provided proximate the front panel 20 and the ventilation tower 10. In this manner, selective operation of the blower 36 draws ventilation air 42 into the ventilation tower 10 via the side vent 60. The positioning of the side vent 60 allows for movement of ventilation air 42 into the side vent 60 from an external region 44 in front of the cooking appliance 14. Accordingly, this ventilation air 42 in front of the cooking appliance 14 takes the form of cooling air 62 that can be moved into the air handling system 12 for the cooking appliance 14 for cooling the cabinet structure 50, the front panel 20, a handle 64 attached to the operable door panel 30, the operable door panel 30 itself, and other portions of the outer surface 40 of the housing 16 for the cooking appliance 14.

During operation of the blower 36, as exemplified in FIGS. 3-6, the blower 36 creates a negative pressure area 70 within and around the ventilation towers 10. This negative pressure area 70 causes a suction 72 through the side vent 60 within the ventilation tower 10 that draws the cooling air 62 from the external region 44 in front of the cooking appliance 14, and into the side vent 60. This cooling air 62 is then drawn into the ventilation towers 10 and then drawn into the various interstitial spaces 38 of the cooking appliance 14 defined between the housing 16 and the cabinet structure 50. By creating this negative pressure area 70 within the ventilation towers 10 and causing a suction 72 of cooling air 62 through the side vent 60, the ventilation towers 10 can ensure that fresh air in the form of the cooling air 62 is drawn in from outside of the appliance 14 and into the interstitial spaces 38 surrounding the housing 16. This also ensures that the housing 16, the cabinet structure 50 and the interstitial spaces 38 defined therebetween are not allowed to overheat through a recirculation of heated air 74 that may be present within these interstitial spaces 38 surrounding the housing 16.

During operation of the heat source 34, heat 76 from the heating cavity 22 may infiltrate through the sidewalls 18 and into these interstitial spaces 38. If this heated air 74 within the interstitial spaces 38 is recirculated, the interstitial space 38 may experience an undesirable high temperature that could damage the appliance 14 as well as the cabinet structure 50 surrounding the cooking appliance 14. By positioning the ventilation towers 10 proximate the front panel 20, the blower 36 can create the negative pressure area 70 within and in front of the ventilation towers 10 to draw the cooling air 62 through the side vent 60, into the ventilation tower 10, and toward the blower 36 for delivery throughout the various interstitial spaces 38 of the cooking appliance 14 within the cabinet structure 50. This movement of the cooling air 62 through the interstitial space 38 serves to cool, at least, the cabinet structure 50 surrounding the housing 16

Referring again to FIGS. 1, 3 and 5, during operation of the heat source 34 for the cooking appliance 14, the heat source 34 can deliver heat 76 to areas near the front panel 20. This heat 76 delivered to the front panel 20 can cause the front panel 20 and the cabinet structure 50 to become overly warm or hot to the touch. By drawing the cooling air 62 through the side vent 60 and near the front panel 20, the cooling air 62 can serve to at least partially cool the front panel 20, or at least portions of the front panel 20 and the cabinet structure 50. Accordingly, the use of the ventilation tower 10 drawing air through the side vents 60 can result in a cooler temperature of the front panel 20 and the cabinet structure 50 surrounding the housing 16 during operation of the cooking appliance 14.

Referring again to FIGS. 1, 3 and 4, during operation of the cooking appliance 14, heat 76 may infiltrate through portions of the operable door panel 30 and into a handle 64 attached to the operable door panel 30. By drawing cooling air 62 through the side vent 60 and into the ventilation tower 10 during operation of the blower 36, the negative pressure region can draw the cooling air 62 past these areas and also draw heat 76 away from the front panel 20, operable door panel 30 and the handle 64 to prevent these portions of the cooking appliance 14 from being unnecessarily heated during operation of the heat source 34. In this manner, movement of the cooling air 62 through the ventilation tower 10, as well as the suction 72 of the cooling air 62 into the ventilation tower 10 via the side vent 60, can limit thermal communication between the heat source 34 and the handle 64 for the operable door panel 30.

Referring again to FIGS. 3-10, the ventilation tower 10 can include an inner panel 80 and an outer panel 82 that cooperate to form the ventilation tower 10. The inner panel 80 and outer panel 82 define an air channel 84 that extends between the side vent 60 and the interstitial space 38 where the blower 36 is typically located. The inner panel 80 and outer panels 82 define a top aperture 86 positioned proximate a portion of the interstitial space 38 that houses the blower 36 and the air channel 84. The inner and outer panels 80, 82 of the ventilation tower 10 can connect with one another to form a series of enclosed edges 88 that contain the air channel 84 therein to extend between the side vent 60 and the top aperture 86. Selective operation of the blower 36 generates suction 72 within the ventilation tower 10 and through the side vent 60 that draws cooling air 62 from the external region 44 in front of the cooking appliance 14. This cooling air 62 moves through the ventilation tower 10 and forms at least part of the ventilation air 42 that is moved through the interstitial space 38 via the air channel 84 and the top aperture 86 that are formed by the ventilation tower 10. As discussed above, the interstitial space can be at least partially defined between the housing 16 and the cabinet structure 50.

Referring again to FIGS. 3-10, during operation of the blower 36, the negative pressure area 70 can be formed within the air channel 84 to draw cooling air 62 through the side vent 60 and into the ventilation tower 10. During use of the blower 36, amounts of heated air 74 within the interstitial space 38 may also be recirculated. The inclusion of the ventilation tower 10 allows for the addition of cooling air 62 to be mixed with the ventilation air 42 to prevent any recirculated heated air 74 from achieving temperatures that are above a desired heat level. Accordingly, the addition of the cooling air 62 through the side vent 60 in the ventilation tower 10 can at least partially cool the ventilation air 42 that circulates throughout the interstitial space 38.

In various aspects of the device, the interstitial space 38 that surrounds at least a portion of the housing 16 for the cooking appliance 14 can include a superior area 100 that is typically positioned above the housing 16. Operation of the blower 36 serves to move the ventilation air 42 from this superior area 100 above the housing 16 to an anterior area 102 typically located behind the housing 16. Operation of the blower 36 moves the ventilation air 42, which typically includes some cooling air 62 obtained through the ventilation tower 10, and moves this combined ventilation air 42 and cooling air 62 sequentially through the superior area 100 and anterior area 102 to a ventilation outlet 104 of the air handling system 12.

According to various aspects of the device, the ventilation outlet 104 can be positioned within the front panel 20 at a lower portion 110 of the front panel 20. Accordingly, the ventilation air 42 that is moved through the ventilation outlet 104 is pushed through a lower portion 110 of the front panel 20 and is projected in an outward direction 112 that is generally perpendicular to the front panel 20. During operation of the blower 36, cooling air 62 is drawn or suctioned into the ventilation tower 10 through the side vent 60, because the side vent 60 is oriented substantially parallel with the front panel 20, cooling air 62 is drawn in from areas in front of and toward the sides of the front panel 20 in an inward direction 114 that is generally perpendicular to the outward direction 112. This configuration of the side vent 60 and the ventilation outlet 104 as being oriented in generally perpendicular directions to one another can serve to prevent the negative pressure area 70 within the ventilation tower 10 from drawing in the ejected ventilation air 42 that has left the ventilation outlet 104. This helps to ensure that the cooling air 62 obtained within the ventilation tower 10 through the side vent 60 is at or near room temperature.

Referring again to FIGS. 1-6, a heating and ventilation system for the cooking appliance 14 can include the heat source 34 that selectively delivers heat 76 to the heating cavity 22 defined within the housing 16. The outer ventilation path 116 that can include the superior and anterior areas 100, 102 extends around at least a portion of the outer surface 40 of the housing 16. The ventilation tower 10 for the heating and ventilation system is typically disposed at or proximate a sidewall 18 of the housing 16 and in communication with the outer ventilation path 116. The ventilation tower 10 is also typically disposed at a forward portion 120 of the sidewall 18 adjacent the front panel 20. In various aspects of the device, a rear surface 122 of the front panel 20 can define at least a portion of the side vent 60 through which cooling air 62 is delivered into the ventilation tower 10.

The blower 36 for the heating and ventilation system is typically disposed within the outer ventilation path 116 and is selectively operable to move ventilation air 42 from the ventilation tower 10 and into other areas of the outer ventilation path 116. The ventilation tower 10 includes the side vent 60 that cooperates with the blower 36 to create the negative pressure area 70 that generates the suction 72 for drawing in cooling air 62 from the surrounding environment and to the side vent 60 and into the ventilation tower 10. This negative pressure area 70 causes the suction 72 that draws cooling air 62 from areas around and in front of the cooking appliance 14 for adding to the ventilation air 42 to be maintained or substantially maintained within desired temperatures. The cooling air 62 obtained through the ventilation tower 10 via the side vent 60 moves through the interstitial space 38 to at least partially cool the ventilation air 42 that is contemporaneously moved through the outer ventilation path 116.

As discussed previously, and as exemplified in FIGS. 1-6, the heat source 34 can deliver heat 76 to areas proximate the front panel 20 of the housing 16. The selective movement of the cooling air 62 into the ventilation tower 10 through the side vent 60 delivers at least a portion of this heat 76 away from the front panel 20 and the cabinet structure 50. This heat 76 is then delivered into the outer ventilation path 116 in the form of ventilation air 42.

The operable door panel 30 is coupled to the housing 16 proximate the front panel 20 of the housing 16. The operable door panel 30 provides selective access to the heating cavity 22 via the aperture 32 defined within the front panel 20. According to various aspects of the device, the operable door panel 30 can be a rotationally operable door, a sliding panel, a vertically or horizontally translating door that is connected by a linkage mechanism with the housing 16, and other similar door panel 30 types. The handle 64 is typically attached to the operable door panel 30 and the ventilation tower 10 is positioned adjacent to the front panel 20 and proximate the handle 64 of the operable door panel 30 when the operable door panel 30 is in a closed position 130. Movement of the cooling air 62 through the side vent 60 to define at least a portion of the ventilation air 42 that is moved through the outer ventilation path 116 at least partially limits thermal communication between the heat source 34 and the handle 64. In this manner, heat 76 can be directed away from the handle 64 to prevent the handle 64 from achieving the unnecessarily high temperature that may be undesirable to users of the appliance 14.

Referring again to FIGS. 3-6, the inner and outer panels 80, 82 of the ventilation tower 10 can be coupled together to define the air channel 84. This air channel 84 typically extends from the side vent 60 to the outer ventilation path 116. Cooling air 62 moving through the air channel 84 is projected into the outer ventilation path 116 through a top aperture 86 that is defined between the inner and outer panels 80, 82.

Referring again to FIGS. 3-10, the inner panel 80 of the ventilation tower 10 typically attaches to a portion of the exterior of the housing 16. This inner panel 80 can include a seat 140 that receives a portion of the outer panel 82, where the outer panel 82 rests within the seat 140 and is supported by the inner panel 80. The outer panel 82, seated within the inner panel 80, can include a rear flange 142 that at least partially overlaps a portion of the inner panel 80. The various flanges of the inner and outer panels 80, 82 are configured to enclose portions of the air channel 84 to allow for the directional movement of the cooling air 62 and ventilation air 42 through the ventilation tower 10 and into the outer ventilation path 116.

Referring again to FIGS. 2-7, the inner and outer panels 80, 82 define a front opening 150 that is situated near the side vent 60 to allow the negative pressure area 70, generated by operation of the blower 36, to draw or suction cooling air 62 in through the side vent 60 and into the air channel 84 of the ventilation tower 10. The inner and outer panels 80, 82 define enclosed edges 88 at the bottom and rear of the ventilation tower 10. A top aperture 86 is also defined between the inner and outer panels 80, 82, where the top aperture 86 allows for the cooling air 62 and/or ventilation air 42 to move through the air channel 84 and into the outer ventilation path 116 defined within the interstitial space 38 of the cooking appliance 14.

In various aspects of the device, the inner and outer panels 80, 82 can be stamped members that can be connected together to define the ventilation tower 10 for incorporation within the heating and ventilation system of the appliance 14. In such an embodiment, the inner panel 80 can be attached or otherwise connected to a side panel 160 of the housing 16. The outer panel 82 can then attach to the inner panel 80. The front opening 150 defined between the inner and outer panels 80, 82 serves to receive the suctioned cooling air 62 through the side vent 60 and allows for this cooling air 62 to be suctioned into the air channel 84 defined within the ventilation tower 10. The inner and outer panels 80, 82 can be connected via various connecting methods and mechanisms that can include, but are not limited to, welding, fasteners, adhesives, mating engagements, combinations thereof, and other similar connecting methods and mechanisms.

Referring again to FIGS. 1-10, the heating appliance 14 can be in the form of a double oven or stacked oven that can be positioned within a cabinet structure 50. In such an embodiment, the heating appliance 14 can include an upper housing 52 that has an upper heat source 170 that delivers heat 76 to the upper heating cavity 172 defined within the upper housing 52. The heating appliance 14 can also include a lower housing 54 that includes a lower heat source 174 that delivers heat 76 to a lower heating cavity 176 defined within the lower housing 54. The heating and ventilation system for the appliance 14 includes an outer ventilation path 116 that extends around an outer surface 40 of each of the upper and lower housings 52, 54. In this manner, this interstitial space 38 for the double oven configuration of the heating appliance 14 can extend between the upper and lower housings 52, 54 and also between the housing 16 and the cabinet structure 50 that surrounds the upper and lower housings 52, 54 of the cooking appliance 14.

Upper and lower ventilation towers 180, 182 can be disposed at or proximate sidewalls 18 of the upper and lower housings 52, 54, respectively. In this manner, each of the upper and lower housings 52, 54 include a dedicated side vent 60 that draws cooling air 62 into the upper and lower ventilation towers 180, 182, respectively, and into the outer ventilation path 116 for the appliance 14. The outer ventilation path 116 for the appliance 14 can extend above the upper housing 52, between the upper and lower housings 52, 54, behind one or both of the upper and lower housings 52, 54 and to one or more dedicated ventilation outlets 104. Where one ventilation outlet 104 is included, that ventilation outlet 104 is typically positioned below each of the upper and lower housings 52, 54.

At least one blower 36 is disposed within the outer ventilation path 116. Operation of this blower 36 is selectively operable to move ventilation air 42 from at least one of the upper and lower ventilation towers 180, 182 and into the outer ventilation path 116. As discussed previously, each ventilation tower 10 of the upper and lower ventilation towers 180, 182 includes a side aperture 32 that cooperates with the blower 36 to direct cooling air 62 from areas external to the outer ventilation path 116 and in front of the appliance 14. This cooling air 62 is moved through the respective side vent 60 and into the respective upper and lower ventilation towers 180, 182. The cooling air 62 is then moved into the outer ventilation path 116 via the upper and lower ventilation towers 180, 182 to at least partially define the ventilation air 42 that is moved through the outer ventilation path 116.

In various aspects of the device, the appliance 14 can include upper and lower blowers 190, 192 that can operate selectively and independently with respect to one another. In such an embodiment, an upper blower 190 typically operates with an upper ventilation tower 180 and a lower blower 192 cooperates with a lower ventilation tower 182. Additionally, where separate blowers 36 are included, each housing 16 may include its own dedicated outer ventilation path 116 and dedicated ventilation outlet 104. Alternatively, and as discussed above, a single blower 36 may be used to move ventilation air 42 through a single outer ventilation path 116 and to also generate the negative pressure areas 70 within and around the ventilation towers 10 for drawing cooling air 62 through the side apertures 32 and into the air channel 84 for each of the upper and lower ventilation towers 180, 182.

Referring again to FIGS. 1-6, each of the upper and lower doors 194, 196 can include upper and lower handles 198, 200, respectively. In this manner, the upper door 194, being coupled to the upper housing 52 and the lower door 196 coupled to the lower housing 54 provides alternative and selective access to the upper and lower heating cavities 172, 176, respectively. The upper and lower handles 198, 200 that are attached to the upper and lower doors 194, 196, respectively, can be respectively positioned proximate the upper and lower ventilation towers 180, 182 so that heat 76 from the upper and lower heat sources 170, 174 can be directed away from the upper and lower handles 198, 200. As discussed previously, as cooling air 62 moves through the various ventilation towers 10, heat 76 from the heat source 34 can be drawn away from the front panel 20, the operable door panel 30 and the various handles 64. The cooling air 62 from the ventilation towers 10 also draws heat away from the cabinet structure 50 surrounding the upper and lower housings 52, 54. This suction 72 of the cooling air 62 through the ventilation towers 10 can prevent these areas from achieving excessive temperatures that may be undesirable by users of the appliance 14. In this manner, the upper ventilation tower 180 is positioned proximate the upper handle 198 and the lower ventilation tower 180, 182 is positioned proximate the lower handle 200. In this manner, the upper and lower ventilation towers 180, 182 serve to at least partially limit thermal communication from the upper and lower heat sources 170, 174, respectively, to the respective upper and lower handles 198, 200 and also to the cabinet structure 50.

In various aspects of the device, as exemplified in FIGS. 1-10, the various side vents 60 of the upper and lower ventilation towers 180, 182 can be positioned proximate the front panels 20 of the upper and lower housings 52, 54, respectively. Each of these side vents 60 is oriented to draw cooling air 62 from regions in front of and adjacent to the front panel 20. In this manner, cooling air 62 is suctioned into the side vents 60 or drawn into the side vents 60 in an inward direction 114 generally parallel with outer surfaces 40 of the front panels 20 for the appliance 14. As discussed previously, this directional suction 72 of cooling air 62 from areas around and adjacent to the heating appliance 14 can serve to limit the amount of ejected, and typically heated, ventilation air 42 that is recirculated back into the side vents 60 during operation of the blower 36. This also ensures that the cooling air 62 is substantially at room temperature or close to room temperature and minimal amounts of ejected ventilation air 42 is drawn back to the side vents 60.

According to various aspects of the device, the side ventilation towers 10 can be utilized within various heating-type appliances 14. These appliances 14 can include, but are not limited to, ovens, water heaters, dishwashers, laundry-type appliances, refrigerators, freezers, various small appliances, and other similar appliances and fixtures located within commercial and residential settings.

In various aspects of the device, the sidewalls 18 of the appliance 14 can be modified to incorporate various aspects of the ventilation tower 10. The inner panel 80 of the ventilation tower 10 can be seated within a side panel 160 for the housing 16. It is also contemplated that the inner panel 80 for the ventilation tower 10 can be incorporated within, or integrally formed as part of, this side panel 160. In such an embodiment, the outer panel 82 for the ventilation tower 10 can be attached to the side panel 160 to form the air channel 84, front opening 150 and top aperture 86 for moving cooling air 62 from the side vent 60 and into the interstitial space 38. A top panel 210 for the housing 16 can also be modified to allow for incorporation of the ventilation tower 10 therein. A cutout 212 can be provided in the top panel 210 to allow for attachment of the inner panel 80 of the ventilation tower 10. Accordingly, the side panel 160 and top panel 210 of the housing 16 can be used to at least partially define the air channel 84 that moves the cooling air 62 from the side vent 60, through the air channel 84, and into the interstitial space 38 that forms at least a portion of the outer ventilation path 116. The side panel 160, top panel 210, and inner and outer panels 80, 82 of the ventilation tower 10 can be used to at least partially seal off areas of the air channel 84 to allow for formation of the negative pressure area 70 that suctions 72 or draws cooling air 62 in through the side vents 60 and through the air channel 84 for delivery to the outer ventilation path 116.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A cooking appliance comprising:

a housing having a sidewall and a front panel, wherein a heating cavity is defined within the housing;

an operable door panel rotationally coupled proximate the front panel and operable to provide selective access to the heating cavity via an aperture defined within the front panel;

a heat source in thermal communication with the heating cavity and the front panel;

a blower disposed within an interstitial space at least partially defined by an outer surface of the housing; and a ventilation tower attached to the sidewall and positioned proximate the front panel, wherein selective operation of the blower draws ventilation air from an external region proximate the front panel and into the interstitial space via the ventilation tower, wherein the ventilation tower is positioned adjacent a handle of the operable door panel, wherein movement of the ventilation air at least partially limits thermal communication between the heat source and the handle.

2. The cooking appliance of claim 1, further comprising:

a side vent defined proximate the front panel and the ventilation tower, wherein selective operation of the blower draws the ventilation air into the ventilation tower via the side vent.

3. The cooking appliance of claim 2, wherein operation of the heat source delivers heat to the front panel, and wherein selective movement of the ventilation air through the side vent delivers at least a portion of the heat from the front panel to the interstitial space.

4. The cooking appliance of claim 2, wherein the ventilation tower includes an inner panel and an outer panel, and wherein the inner and outer panels define an air channel that extends between the side vent and the interstitial space.

5. The cooking appliance of claim 4, wherein the inner and outer panels define a top aperture positioned proximate the interstitial space and the air channel, wherein selective operation of the blower draws the ventilation air from the side vent and to the interstitial space via the air channel and the top aperture.

6. The cooking appliance of claim 1, wherein the interstitial space extends from a superior area above the housing to an anterior area behind the housing, and wherein operation of the blower moves the ventilation air sequentially through the superior and anterior areas and to a ventilation outlet.

7. The cooking appliance of claim 6, wherein the ventilation outlet is disposed proximate a lower portion of the front panel.

8. A heating and ventilation system for a cooking appliance, the heating and ventilation system comprising:

a heat source that selectively delivers heat to a heating cavity defined within a housing;

an outer ventilation path that extends around at least a portion of an exterior of the housing;

a ventilation tower disposed proximate a sidewall of the housing and in communication with the outer ventilation path;

a blower disposed within the outer ventilation path and selectively operable to move ventilation air from the ventilation tower and into the outer ventilation path, wherein the ventilation tower includes a side vent that cooperates with the blower to direct cooling air from areas external to the outer ventilation path into the ventilation tower to at least partially define the ventilation air;

an operable door panel coupled to the housing proximate a front panel of the housing, wherein the operable door panel provides selective access to the heating cavity via an aperture defined within the front panel; and a handle attached to the operable door panel, wherein the ventilation tower is positioned adjacent the front panel and proximate the handle of the operable door panel, wherein movement of the ventilation air through the side vent at least partially limits thermal communication from the heat source and to the handle.

9. The heating and ventilation system of claim 8, wherein operation of the heat source delivers heat to a front panel of the housing, and wherein selective movement of the ventilation air through the side vent delivers at least a portion of the heat from the front panel to the outer ventilation path.

10. The heating and ventilation system of claim 9, wherein the ventilation tower includes inner and outer panels that define an air channel therebetween that extends from the side vent to the outer ventilation path.

11. The heating and ventilation system of claim 10, wherein the inner panel is coupled to the front panel and the sidewall of the housing and the outer panel is coupled to the inner panel to define the side vent proximate the front panel.

12. The heating and ventilation system of claim 11, wherein the inner and outer panels define a top aperture positioned proximate the outer ventilation path, wherein selective operation of the blower draws the ventilation air from the side vent and to the outer ventilation path via the top aperture.

13. The heating and ventilation system of claim 8, wherein the outer ventilation path extends from a superior area above the housing to an anterior area behind the housing, and wherein operation of the blower moves the ventilation air sequentially through the superior and anterior areas and to a ventilation outlet.

14. The heating and ventilation system of claim 13, wherein the ventilation outlet is disposed proximate a lower portion of the front panel of the housing.

15. A heating appliance comprising:

an upper housing including an upper heat source that delivers heat to an upper heating cavity defined within the upper housing;

a lower housing including a lower heat source that delivers heat to a lower heating cavity defined with in the lower housing;

a heating and ventilation system that includes an outer ventilation path extending around an outer surface of each of the upper and lower housings;

upper and lower ventilation towers disposed at sidewalls of the upper and lower housings, respectively, each of the upper and lower ventilation towers in communication with the outer ventilation path;

at least one blower disposed within the outer ventilation path and selectively operable to move ventilation air from at least one of the upper and lower ventilation towers and into the outer ventilation path, wherein each ventilation tower of the upper and lower ventilation towers includes a side vent that cooperates with the at least one blower to direct cooling air from areas external to the outer ventilation path and the upper and lower housings and into the outer ventilation path to partially define the ventilation air;

an upper door coupled to the upper housing, wherein the upper door provides selective access to the upper heating cavity; and an upper handle attached to the upper door, wherein the upper ventilation tower is positioned proximate the upper handle, wherein movement of the ventilation air through the side vent of the upper ventilation tower and into the outer ventilation path at least partially limits thermal communication from the upper heat source and to the upper handle.

16. The heating appliance of claim 15, wherein the at least one blower includes an upper blower that moves ventilation air through a superior portion of the outer ventilation path and a lower blower that moves ventilation air through a lower portion of the outer ventilation path.

17. The heating appliance of claim 15, wherein the side vent of the upper and lower ventilation towers are positioned proximate upper and lower front panels of the upper and lower housings, respectively, and wherein each side vent is oriented to draw cooling air from a direction generally parallel with outer surfaces of the upper and lower front panels.

* * * * *